US009604446B2

(12) United States Patent
Franz et al.

(10) Patent No.: US 9,604,446 B2
(45) Date of Patent: Mar. 28, 2017

(54) INKING UNIT OF A PRINTING UNIT, PRINTING UNIT AND METHOD FOR OPERATING A PRINTING UNIT

(71) Applicant: KOENIG & BAUER AKTIENGESELLSCHAFT, Würzburg (DE)

(72) Inventors: Sebastian Franz, Leinach (DE); Patrick Kress, Bad Mergentheim-Edelfingen (DE); Volkmar Schwitzky, Wurzburg (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 14/432,550

(22) PCT Filed: Sep. 23, 2013

(86) PCT No.: PCT/EP2013/069687
§ 371 (c)(1),
(2) Date: Mar. 31, 2015

(87) PCT Pub. No.: WO2014/056711
PCT Pub. Date: Apr. 17, 2014

(65) Prior Publication Data

US 2015/0290927 A1 Oct. 15, 2015

(30) Foreign Application Priority Data

Oct. 10, 2012 (DE) ..... 10 2012 218 417
Oct. 10, 2012 (DE) ..... 10 2012 218 423

(51) Int. Cl.
*B41F 31/14* (2006.01)
*B41F 31/15* (2006.01)
(Continued)

(52) U.S. Cl.
CPC ..... *B41F 31/004* (2013.01); *B41F 13/0008* (2013.01); *B41F 31/14* (2013.01); *B41F 31/15* (2013.01); *B41F 31/26* (2013.01)

(58) Field of Classification Search
CPC ..... B41F 31/15; B41F 31/14; B41F 31/36; B41F 31/004; B41F 13/0008
See application file for complete search history.

(56) References Cited

U.S. PATENT DOCUMENTS 4,524,692 A 6/1985 Rodvelt
6,311,617 B1 * 11/2001 Herden ..... B41F 31/14 101/350.3
(Continued)

FOREIGN PATENT DOCUMENTS

DE 1761394 B1 2/1972
DE 2144636 B1 3/1973
(Continued)

OTHER PUBLICATIONS

A. Computer, EP 1 916 110 A2 Machine Translation, Nov. 2, 2015,
A. Different Computer, Edition 1, vol. 1, All of the pages.*
(Continued)

*Primary Examiner* — Blake A Tankersley
*Assistant Examiner* — Leo T Hinze
(74) *Attorney, Agent, or Firm* — Mattingly & Malur, PC

(57) ABSTRACT

Inking units of a printing unit having at least one first inking unit roll and having a second inking unit roll which can be pivoted between the first inking unit roll and a third inking unit roll, at a distance from the first inking unit roll. A pivot drive for pivoting the second inking unit roll is provided with a drive assembly which is mechanically independent from the rotation of cylinders of the printing unit and also from inking unit rolls provided in the inking unit. A screwing down force for at least one of the first and third inking unit
(Continued)

rolls can be set by one of predefining and changing a set point value relating to the drive force of the drive assembly remotely by the actuation of an adjusting assembly.

19 Claims, 8 Drawing Sheets

(51) Int. Cl.

| | |
|---|---|
| ***B41F 31/00*** | (2006.01) |
| ***B41F 31/26*** | (2006.01) |
| ***B41F 13/00*** | (2006.01) |

(56) References Cited

U.S. PATENT DOCUMENTS

| | | | | |
|---|---|---|---|---|
| 6,672,208 | B2 | 1/2004 | Bechtler et al. | |
| 8,065,957 | B2 | 11/2011 | Schaede et al. | |
| 8,261,661 | B2 * | 9/2012 | Masuch | B41F 13/38 101/216 |
| 8,528,477 | B2 | 9/2013 | Schaede et al. | |
| 2007/0006757 | A1 * | 1/2007 | Kusaka | B41F 31/14 101/350.1 |

FOREIGN PATENT DOCUMENTS

| | | | | |
|---|---|---|---|---|
| DE | 2907042 | A1 | 9/1980 | |
| DE | 3935215 | A1 | 5/1990 | |
| DE | 19511488 | A1 | 10/1996 | |
| DE | 19828142 | A1 | 12/1999 | |
| DE | 10152938 | A1 | 6/2002 | |
| DE | 10259495 | A1 | 7/2003 | |
| EP | 158945 | A2 | 10/1985 | |
| EP | 1916110 | A2 | 4/2008 | |
| FR | GB 1215517 | A * | 12/1970 | B41F 31/14 |
| GB | 1398399 | | 6/1975 | |
| JP | 5-24362 | A | 3/1993 | |
| JP | 11-77975 | A | 3/1999 | |
| JP | 2006-335023 | A | 12/2006 | |
| JP | 2007-7881 | A | 1/2007 | |
| JP | 2007-237638 | A | 9/2007 | |
| JP | 2008-126508 | A | 6/2008 | |
| JP | 2009-202391 | A | 9/2009 | |
| WO | 2007105061 | A1 | 9/2007 | |

OTHER PUBLICATIONS

Parker, Industrial Hydraulic Technology, 2001, Parker Hannifin Corporation, Second Edition, p. 11-1.*

* cited by examiner

INKING UNIT OF A PRINTING UNIT, PRINTING UNIT AND METHOD FOR OPERATING A PRINTING UNIT

CROSS REFERENCE TO RELATED APPLICATIONS

This application is the U.S. National Phase, under 35 U.S.C. §371, of PCT/EP2013/069687, filed Sep. 23, 2013; published as WO 2014/056711 A1 on Apr. 17, 2014, and claiming priority to DE 10 2012 218 423.6, filed Oct. 10, 2012 and to DE 10 2012 218 417.1, filed Oct. 10, 2012, the disclosures of which are expressly incorporated herein by reference.

FIELD OF THE INVENTION

The present invention relates to inking units of a printing unit, a printing unit and a method for operating a printing unit. The inking unit has at least one first inking unit roller and a second inking unit roller which can be pivoted between the first inking unit roller and a third inking unit roller which is spaced at a distance from the first inking unit roller. A pivot drive is usable for pivoting the second inking unit roller by the use of a drive assembly which is mechanically independent of the rotation of the printing unit cylinders and of the inking unit rollers provided in the printing unit. A contact force relative to the first and/or the third inking unit roller can be set by predefining and/or modifying a setpoint value relating to the driving force of the drive assembly remotely by acting on an adjustment assembly. The printing unit is usable for simultaneous multicolor printing and includes at least one transfer cylinder and having a plurality of forme cylinders that cooperate with the transfer cylinder. Each forme cylinder has an inking unit in accordance with the present invention.

BACKGROUND OF THE INVENTION

DE 102 59 495 B4 discloses an inking unit with a pivotable ink vibrator roller, wherein a separate drive for pivoting is provided, which is mechanically independent of the rotation of printing unit cylinders and inking unit rollers provided in the printing unit.

DE 39 35 215 A1 discloses a pivot drive for an ink vibrator roller, wherein an electric motor which has a speed controller drives a vibrator cam mechanism.

EP 1 996 403 B1 discloses a collect printing unit for simultaneous, double-sided multicolor printing, in which each of the inking units is equipped with two ink sources for rainbow printing.

DE 195 11 488 A1 concerns a fluid-actuated oscillating piston motor, the drive shaft of which is connected to an object to be pivoted, e.g. a robot arm. Pivoting is carried out between two stop positions, the stops of which are embodied for damping, e.g. as shock absorber mountings.

DE 1 761 394 B discloses a vibrator inking unit having an ink vibrator roller drive and a reversing unit, which can be controlled by means of two adjustable timing control devices for the purpose of adjusting the application period and frequency of synchronized vibration. The drive mechanism is embodied as a double-ended hydraulic cylinder, which is fed with hydraulic fluid from a hydraulic pressure pump via the reversing unit.

DE 298 07 042 U1, DE 21 44 636 B2, EP 0 158 945 A2 and DE 198 28 142 A1 disclose additional examples of embodiments of a vibrator drive having a compressed medium actuation of drive means for generating pivoting motion.

EP 1 916 110 A2 discloses an inking unit for a printing machine and a method for controlling the same, wherein an ink vibrator roller is pivoted between a doctor roller and a transfer roller. Pivoting is carried out by means of a drive device, which comprises a drive motor and a crank driving mechanism for converting the drive motion of the motor to a pivoting motion of a lever. Detection devices for determining the contact pressure that is present can be based on deformations in the lever, torque values, power output of the motor or forces acting on the motor mount, and can forward these to a control device. Detection devices can also be used to obtain signals indicative of a rotation and an angular position, and forward these to the control device. Adjustment means are preferably provided, by which the contact pressure of the ink vibrator roller at the doctor roller or the contact pressure at the transfer roller can be adjusted. The adjustment means are preferably embodied such that corresponding adjustments can be carried out largely automatically, in particular based at the control center.

DE 101 52 839 A1 discloses an ink vibrator roller, the movement of which between the two positions is carried out by controlling or regulating a magnetic bearing device in which the roller is mounted. The movement profile is established, for example, in a position control loop with position reset by predefining setpoint values for position, speed and acceleration. The movement profile can be established differently on the basis of a machine revolution or variably for different machine rotational speeds. To avoid vibrator shock, position control can be provided such that the roller is placed against the doctor roller or the transfer roller at a definable speed and a predefinable contact pressure.

SUMMARY OF THE INVENTION

The object of the present invention is to devise an inking unit for a printing unit, a printing unit, and a method for operating a printing unit with improved ink metering.

The object is attained according to the invention by the provision of the drive assembly as a linear or a rotary drive which is actuable by the application of a compressed fluid. The contact force, relative to the first and/or the third inking unit roller can be set by setting or varying a pressure level of the drive assembly. The drive assembly can be adjusted remotely with respect to an output side driving force.

The advantages that are achievable with the invention consist particularly in an improvement in ink metering quality. This is accomplished by a force-based adjustment, and by a variability and/or variation in the contact force applied by the drive and optionally also by a variability and/or variation in synchronization. To vary the force, a predefined setpoint value for a drive means that effects the pivoting movement can be predefined and/or modified by remote actuation. More particularly, the predefined setpoint value for the output side driving force of the drive means that effects the pivoting movement can be predefined and/or modified by remote actuation. In this process, a control device acts on an adjustment means, in response to an adjustment command input via an operator interface and/or via a control program, for example.

In an advantageous embodiment of the pivot drive, a linear or rotary drive which is actuated by applying a compressed fluid is provided as the drive means, wherein the adjustment force is varied by modifying the pressure level.

This is accomplished by influencing a remotely actuated adjustable valve, for example.

In an alternative embodiment, the drive means can be embodied as an electric drive with an electric motor, which can be and/or is operated in at least one operating mode as torque-controlled, in which case the setpoint value is a preset torque value which can be predefined and/or modified by remotely actuating an adjustment means embodied as a drive controller of the electric drive.

Both embodiments enable the contact force of the pivotable roller to be varied. In this connection it is particularly advantageous that the contact force relative to the ink distribution cylinder and/or the ductor roller and therefore the ink strip width can be adjusted in a simple manner by adjusting or varying the pressure level. This is particularly advantageous when different ink strip widths must be set and/or particularly when the effective contact length will be varied by using sectional vibration rollers, as is sometimes the case, for example, in security printing applications, e.g. in rainbow printing.

The vibrator synchronization in this case is mechanically uncoupled from the machine speed, although it may be embodied as variably correlated thereto. The vibrator synchronization can be freely selected and/or modified—e.g. within certain limits. This offers particular advantages in cases involving the transfer of only a small volume of ink, as is sometimes the case in security printing applications, e.g. in the printing of numbers or seals that contain fine lines.

In an embodiment of the compressed medium-based drive solution which is advantageous in terms of cost and/or in terms of its capacity for precise adjustment, for example, a commercially available, preferably double-ended piston/piston chamber system, in particular a cylinder/piston system is used. In this case, an adjustment to the pressure level already existing in the machine compartment can also be made, for example, by means of the lever lengths.

In an embodiment of the compressed medium-based drive solution which is advantageous in terms of compactness and modular configuration, the drive is embodied as an oscillating piston motor. Said motor engages with its driven member directly in the pivot axis of the pivot lever that bears the ink vibrator roller, for example.

In cases in which, e.g., an interconnected multiple motor drive system, e.g. a drive motor driven synchronously by means of an electronic leading axle, is provided for driving the printing machine, for example, the drive solution involving an electric motor can be advantageous, and can be integrated into the interconnected drive system for the purpose of transmitting the preset torque value.

In an advantageous development, the drive train of the pivot drive is prestressed between drive means and ink vibrator roller, e.g. by means of a spring element, in a pivot direction which is opposite the effect of gravitational force on pivoting.

In contrast to a purely path-based adjustment, the force-based, e.g. compressed medium-based or optionally torque-based adjustment of the ink vibrator roller eliminates the need to readjust the strip width when geometries are varied slightly, e.g. when the elastic circumferential surface of the ink vibrator roller becomes worn.

A savings of mechanical components and measurement and control components is realized, an oil compartment is eliminated or at least decreased in size, and the installation cost and the cost of adjusting the device are reduced substantially over embodiments with vibration cam-based drives.

BRIEF DESCRIPTION OF THE DRAWINGS

Embodiment examples of the invention are represented in the drawings and will be described in greater detail in the following.

The drawings show.

DESCRIPTION OF THE PREFERRED EMBODIMENT

Figure 1:
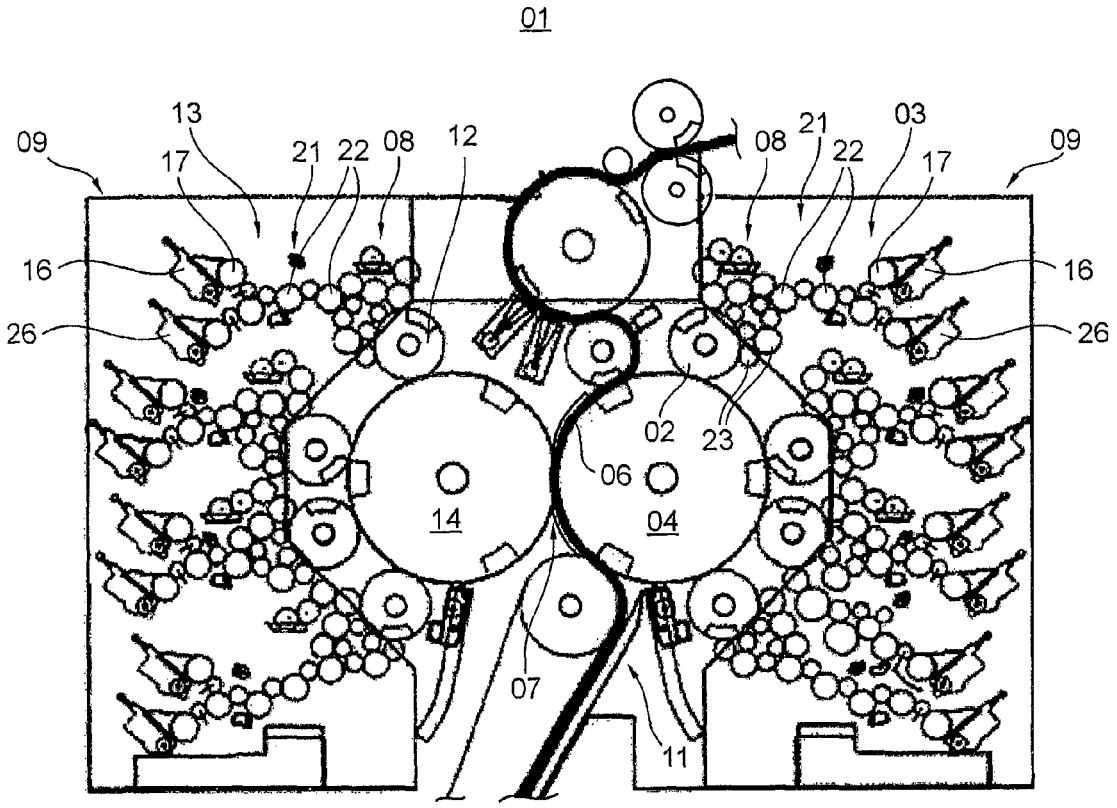
FIG. 1 a schematic representation of a printing unit embodied as a collect printing unit for simultaneous double-sided multicolor printing.
Figure 2:
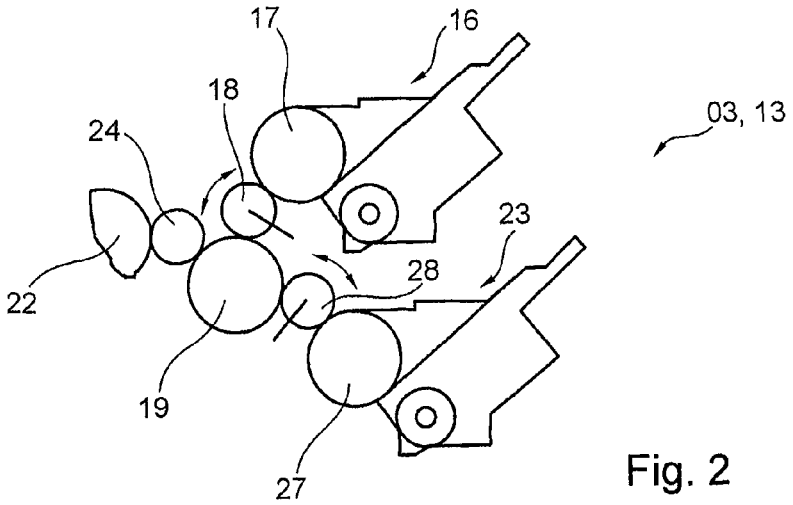
FIG. 2 a section of an inking unit according to FIG. 1.

A printing unit 01 comprises at least one first imaging printing unit cylinder 02 (12), e.g. first forme cylinder 02 (12), and an inking unit 03 (13) which cooperates with forme cylinder 02 (12) for the purpose of inking up said cylinder. Forme cylinder 02 (12) bears a print master on its outer circumference, for example on a printing forme which is affixed to the outer circumference. In the preferred embodiment as an offset printing unit, printing unit 01 comprises at least one first ink conducting printing unit cylinder 04 (14), embodied as a transfer cylinder 04, which cooperates on one side with the at least one first forme cylinder 02 (12) and on the other side, via a printing substrate 06 to be imprinted, with an impression cylinder 14 as printing unit cylinder 14, which serves as a counter bearing for the first transfer cylinder 04 (14). At their nip point, they form a print position 07, where ink is delivered from first transfer cylinder 04 to printing substrate 06. For the case of wet offset printing, as described here, a dampening unit 08 can be assigned to forme cylinder 02. For the alternative case of dry offset printing, said dampening unit can be dispensed with and/or at least not activated.

In a preferred embodiment of printing unit 01 as a blanket-to-blanket printing unit 01 for simultaneous double-sided printing, impression cylinder 14 is embodied as a second transfer cylinder 14, which in turn cooperates with at least one second forme cylinder 12 which can be inked up by an inking unit 13.

In principle, for the preferred embodiment of single-sided or particularly double-sided multicolor printing, a plurality of printing units 01, each comprising an inking unit 03, a forme cylinder and a transfer cylinder 02; 04, or for simultaneous double-sided printing corresponding blanket-to-blanket printing units 01, are provided in succession in the printing substrate path. Preferably however, a plurality of first forme cylinders 02; 12, e.g. four, cooperate in succession, each on its circumferential surface, with the same first transfer cylinder 04; 14 on one side of the printing substrate and form a printing group of a single-sided collect printing unit 09 for simultaneous multicolor printing. A plurality of second forme cylinders 12, e.g. four, with allocated inking units 13 preferably also cooperate with a second transfer cylinder 14 on the other side of the printing substrate forming a single-sided collect printing unit 09, and together with the first printing group form a collect printing unit 01 for simultaneous, double-sided multicolor printing. Between the transfer cylinders 04; 14, print position 07 is embodied as a blanket-to-blanket print position. Collect printing units 01 of this type that imprint on both sides simultaneously are particularly advantageous when stringent requirements in terms of maintaining register—on the same printing substrate side and on both printing substrate sides relative to one another—and/or in terms of a particular coloration must be met. This embodiment of printing unit 01 is preferably configured for double-sided multicolor printing for security printing. Printing substrate 06 can be in web form, or preferably as individual sheets. The two cooperating collect printing units 09 are also referred to as the "front-side printing unit" or "front-side inking unit" (e.g. in FIG. 1, left collect printing unit 09) and the "back-side printing unit" or "back-side inking unit".

The imprinted printing substrate 06, e.g. printing substrate sheet 06, leaves print position 07 after being imprinted and is transported out of printing unit 01, for example, via a correspondingly embodied conveyor device 11, preferably a gripper system 11 having one or more gripper cylinders, or optionally a belt system 11.

Inking unit 03; 13 is embodied as a vibrator inking unit 03; 13 that introduces ink discontinuously, which is particularly advantageous for printing units 01 in which reliable metering and printing must be ensured even with the smallest volumes of ink. This is of particular importance, e.g., in security printing, in particular in offset security printing. Said inking unit comprises at the upstream end at least one ink source 16 (26), e.g. an ink fountain 16 (26) or an ink chamber blade device 16 (26), by which ink can be applied to a (optionally temperature controllable) first inking unit roller 17 (27), e.g. a ductor roller 17 (27) or ink fountain roller 17 (27). Ductor roller 17 (27) is positively rotationally driven, preferably in synchronized steps by means of a stepper motor, for example, with step lengths ranging from e.g. 1° to e.g. 65°. Downstream of ductor roller 17 (27), a second inking unit roller 18 (28), e.g. ink vibrator roller 18 (28), is provided, mounted so as to pivot about a pivot axis S which extends parallel to the rotational axis of ductor roller 17 (27), said ink vibrator roller vibrating during operation between ductor roller 17 (27) and a third inking unit roller 19, also called ink distribution roller 19, which is positioned downstream. So-called ink distribution roller 19 has a hard surface, e.g. with a hardness of at least 60 Shore A. It can be embodied, for example, with a chrome-plated surface or advantageously with a surface made of a plastic, preferably Rilsan®. A roller train 21, composed of a single train or optionally subdivided at least partially into a plurality of parallel sub-trains, is arranged downstream of ink distribution roller 19 in the direction of forme cylinder 02; 12 and has additional rollers, which comprise, for example, at least one inking unit roller 22, e.g. distribution roller 22, embodied as oscillating, and, at the end closest to the forme cylinder, a plurality of inking unit rollers 23, e.g. forme rollers, which cooperate with forme cylinder 02; 12. Between ink distribution roller 19 and a first distribution roller 22 situated downstream thereof, an inking unit roller 24 having a soft surface (e.g. maximum 50 Shore A, preferably maximum 45 Shore A), e.g. ink transfer roller 24, can be provided.

Figure 3:
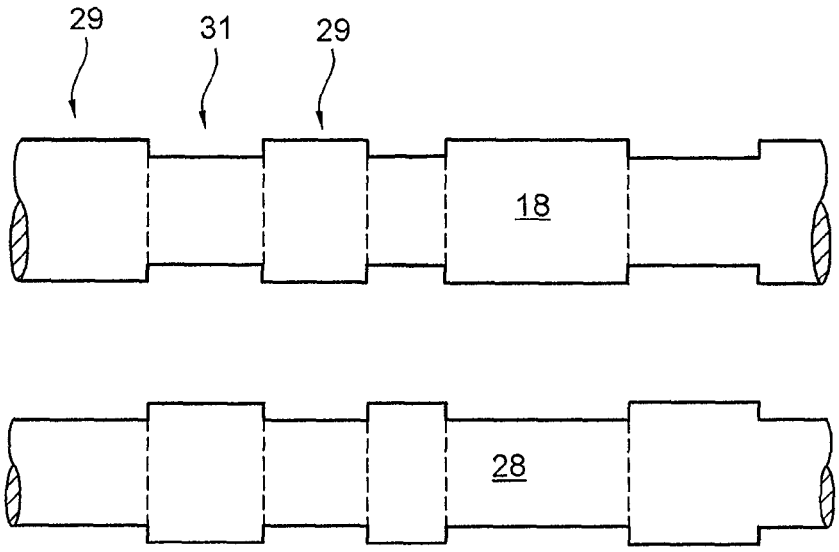
FIG. 3 a schematic diagram showing the principle of roller sections of two correspondingly sectional ink vibrator rollers.
Figure 6:
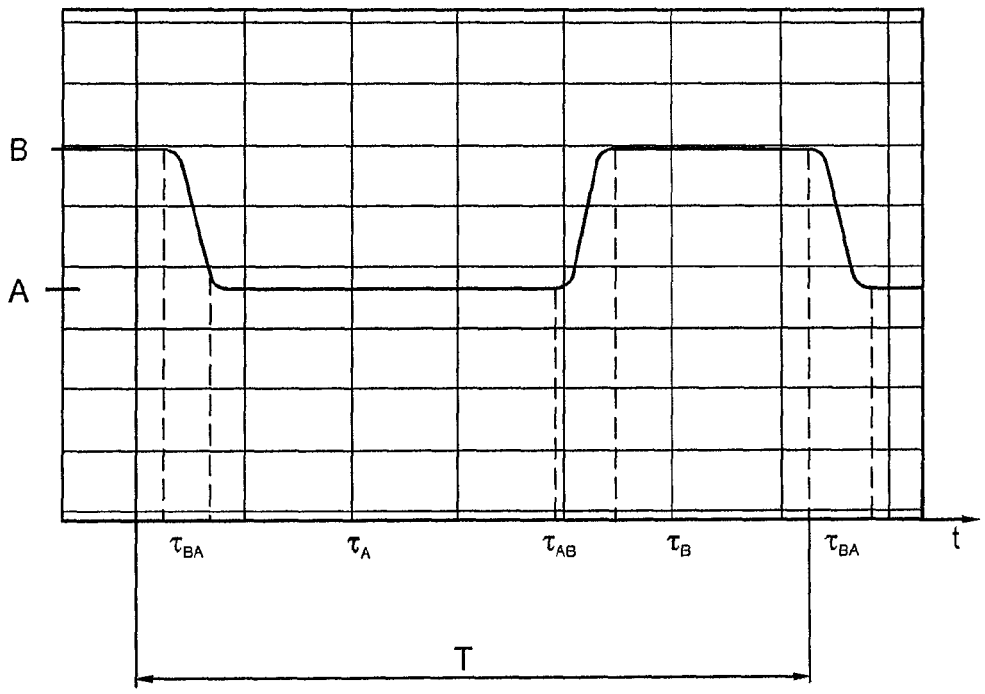
FIG. 6 a schematic representation of a vibrator cycle.
Figure 4:
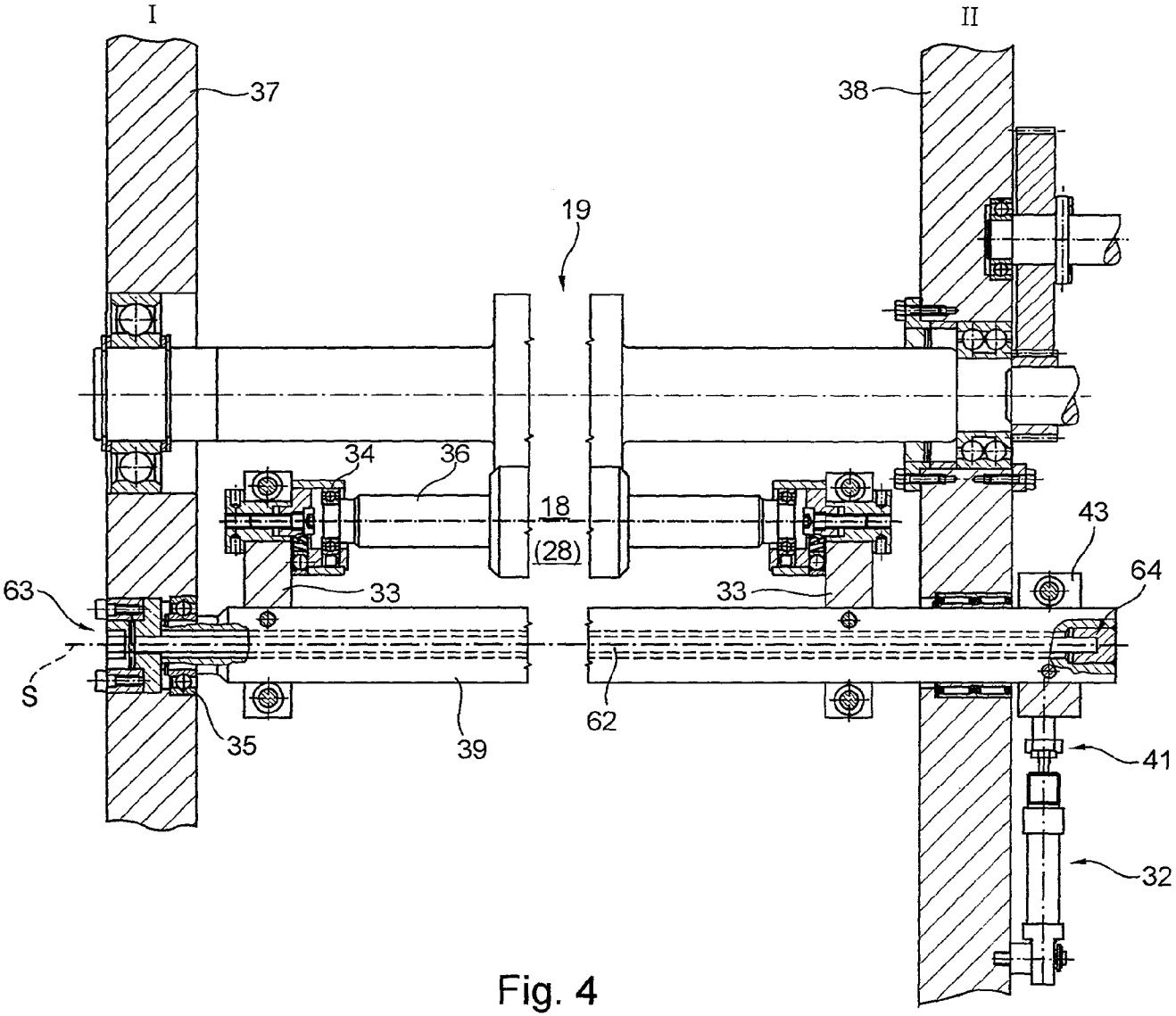
FIG. 4 a sectional view of a first embodiment of an inking unit section comprising ink vibrator roller, ink distribution roller and pivot drive.
Figure 5:
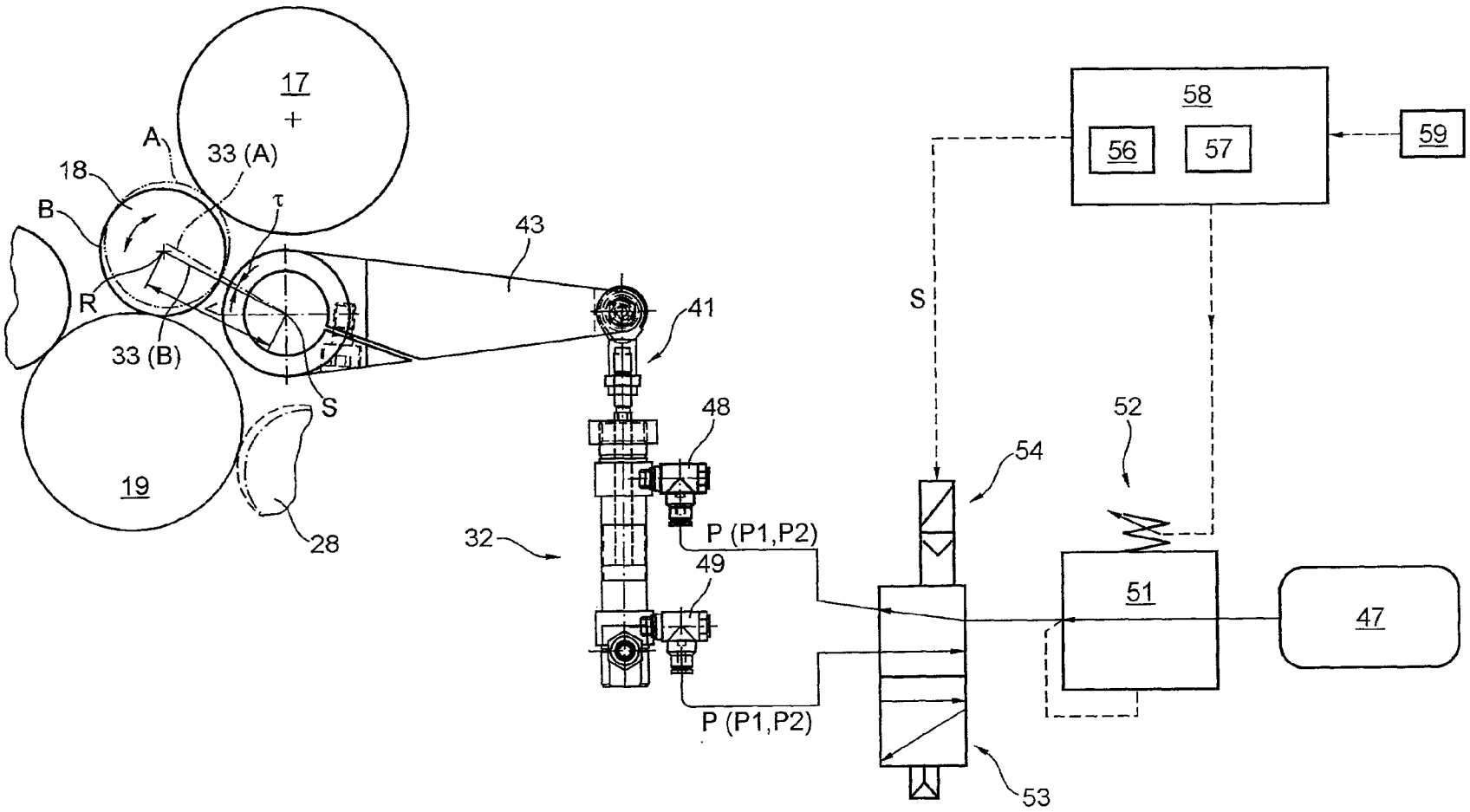
FIG. 5 a schematic side view of an inking unit section comprising ductor roller, ink distribution roller and ink vibrator roller along with the pivot drive, according to a first embodiment of the first embodiment example.
Figure 7:
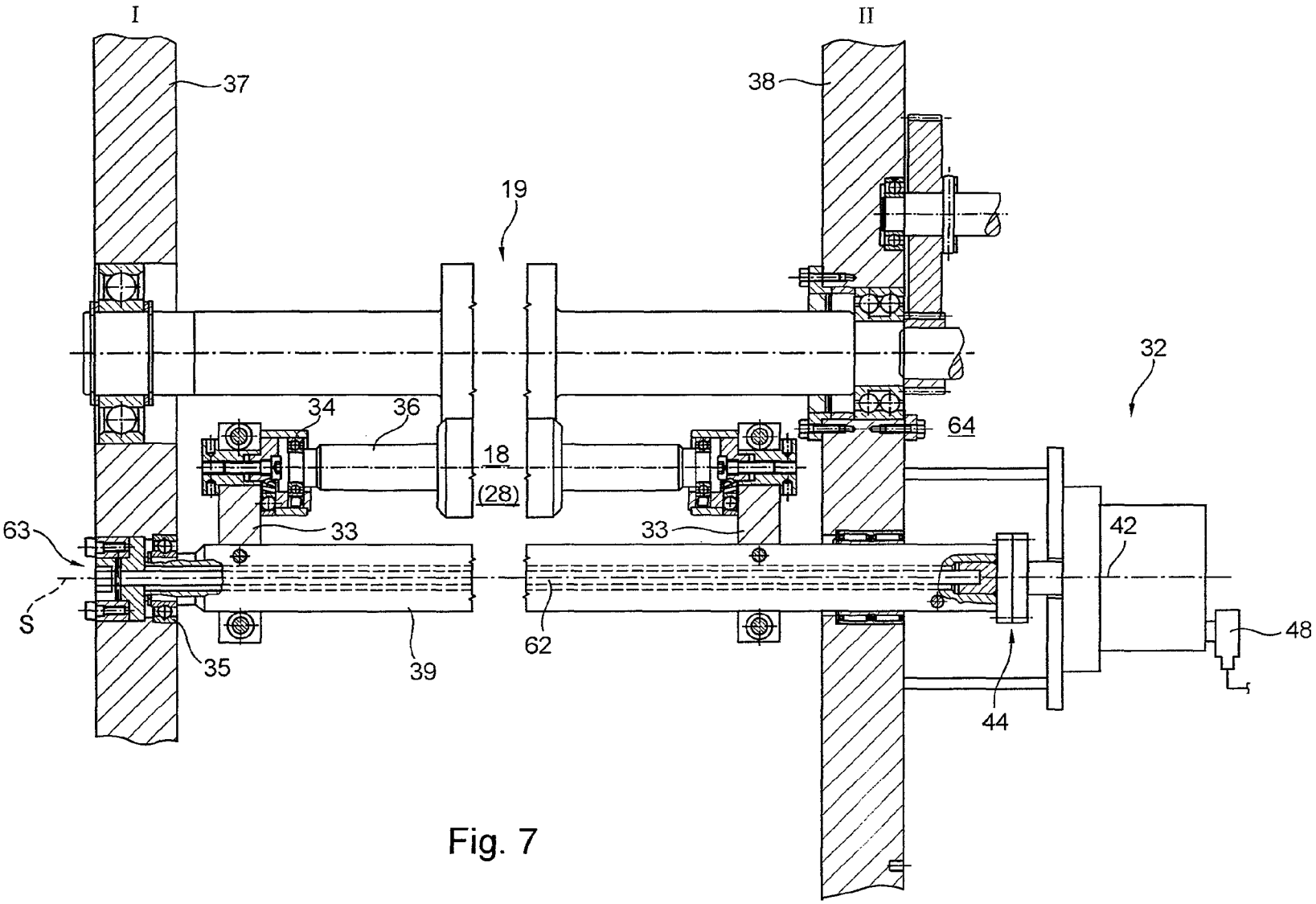
FIG. 7 a sectional view of second embodiment of an inking unit section comprising ink vibrator roller, ink distribution roller and pivot drive.
Figure 8:
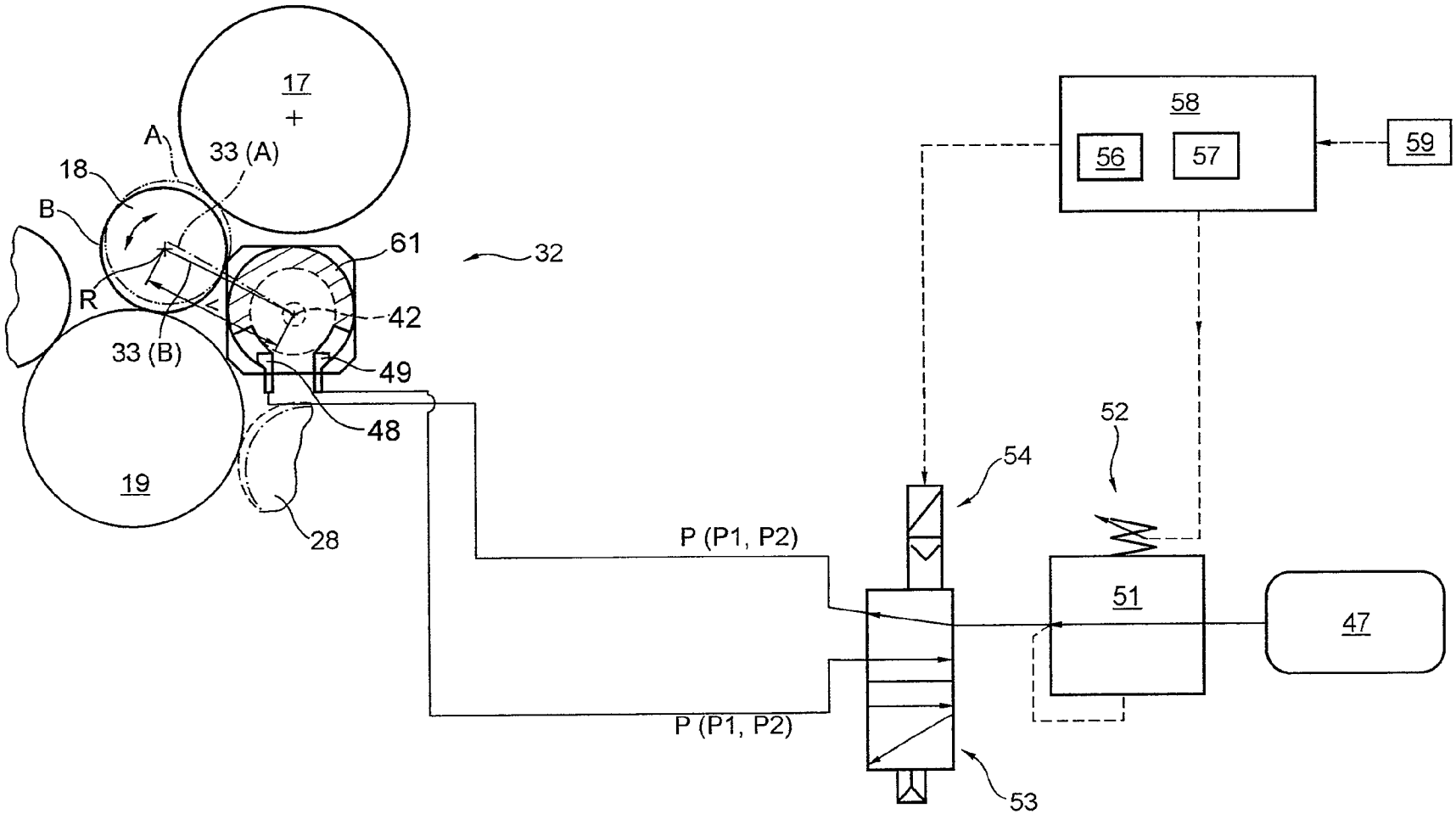
FIG. 8 a schematic side view of an inking unit section comprising ductor roller, ink distribution roller and ink vibrator roller along with the pivot drive, according to a second embodiment of the first embodiment example.
Figure 9:
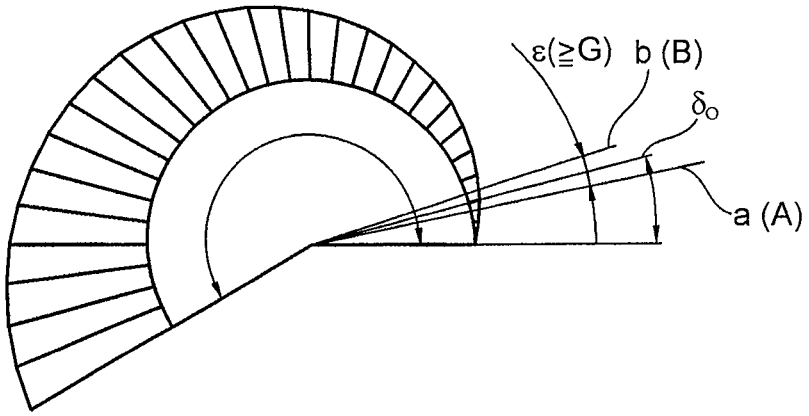
FIG. 9 an example of a spring load/deflection curve of a torsion bar spring.
Figure 10:
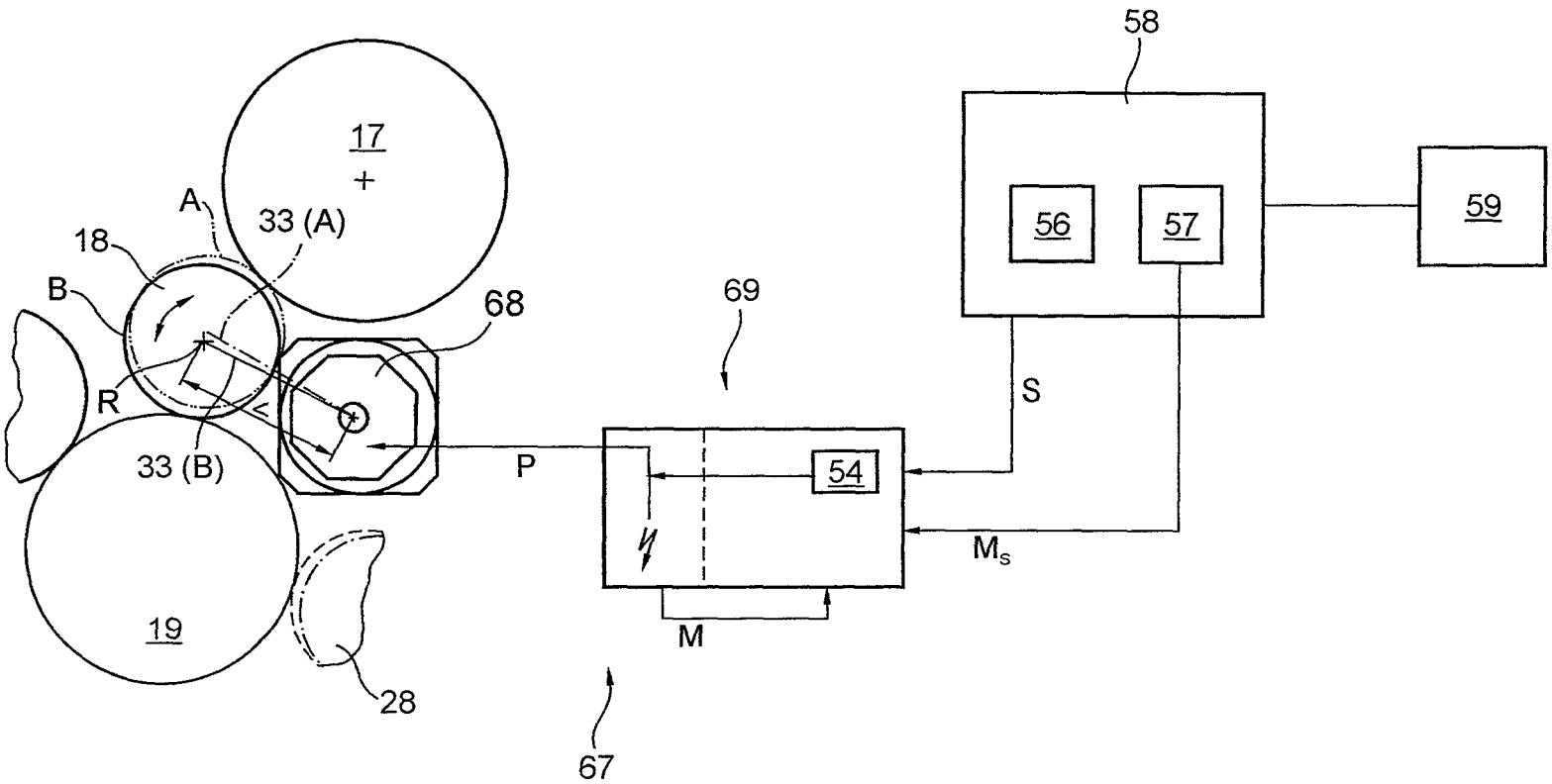
FIG. 10 a schematic side view of an inking unit section comprising ductor roller, ink distribution roller and ink vibrator roller along with the pivot drive, according to a second embodiment example.

In a preferred embodiment of inking unit 03; 13, said unit is embodied as having two ink sources 16; 26 to enable a parallel infeed of ink into inking unit 03; 13, the ink infeed beginning at the respective ink source 16; 26, e.g. according to the above description at respective ink source 16; 26, and proceeding via a ductor roller 17; 27 and an ink vibrator roller 18; 28 to a point downstream on a common inking unit roller 19, in particular on the same ink distribution roller 19. This parallel ink infeed enables two-color printing using the same inking unit, in which two inks can be printed side by side or merging into one another ("rainbow printing"). Ink vibrator rollers 18; 28 each have a circumferential surface, e.g. in the axial direction, having a profile in the longitudinal direction on which raised, strip-shaped continuous sections 29 are interrupted by at least one strip-shaped continuous section 31 which is recessed in relation to the circumferential surface line of the raised sections 29 (see, e.g. schematically enlarged diagram in FIG. 3). An ink vibrator roller 18; 28 profiled in this manner in longitudinal sections is also referred to as "sectional". The lengths of the respective sections 29; 31 need not be equal, and may instead differ based on the requirements of the print image on the ink vibrator roller 18; 28, and from ink vibrator roller 18; 28 to ink vibrator roller 18; 28. In the case of sectional ink vibrator rollers 18; 28, the total fraction of raised, that is bearing sections 29 over the roller length (i.e. the maximum usable cylinder length) can likewise vary to a greater or lesser extent, e.g. between 10% and 90%, depending on requirements. The ink is thus introduced by ductor roller 17 into inking unit 03; 13 only in the axial region of raised sections 29. The strip-shaped introduction of two inks allows one inking unit 03; 13 to be used for inking up the same forme cylinder 02; 12 and/or the same printing forme provided on said forme cylinder 02; 12 with a pattern of inks that merge to a greater or lesser extent, depending on the superposition of the raised sections 29 and/or depending on the oscillation stroke of the at least one distribution roller 22.

Regardless of whether vibrator inking unit 03; 13 is embodied as having one or a plurality of ink sources 16; 26 and/or regardless of whether vibrator inking unit 03; 13 is embodied as having a sectional or non-sectional ink vibrator roller 18; 28, inking unit 03; 13 comprises a pivot drive or a drive means 32 assigned to the pivot drive, which is mechanically independent of the rotational movement, in particular of the positive rotation, of printing unit cylinder 02; 04; 12; 14 assigned to printing unit 01 and/or is mechanically independent of the positive rotation of the positively driven inking unit rollers 17; 18; 19; 22; 23; 23; 24; 27; 28. However, this independent pivot drive, which will be described in greater detail further below, is particularly advantageous in connection with security printing, in particular offset security printing, and/or with the embodiment of printing unit 01 as a collect printing unit 01, in particular as a double-sided collect printing unit 01, and/or with the embodiment of inking unit 03; 13 having two inking unit sources 16; 26 which enables rainbow printing, and/or with the sectional embodiment of at least one ink vibrator roller 18; 28, which is variable in terms of the raised sections.

The pivot drive that effects the pivoting movement of ink vibrator roller 18; 28 comprises, e.g. two levers 33, which are mounted so as to pivot about pivot axis S and on which the end faces of ink vibrator roller 18; 28 are rotatably mounted, each at a distance from pivot axis S. Ink vibrator roller 18; 28 is mounted either as shown by means of radial bearings 34, which are arranged on the levers 33 and in which journals 36 of ink vibrator roller 18; 28 are mounted, or by means of a continuous or divided axle arranged non-rotatably on levers 33, with radial bearings provided on ink vibrator roller 18; 28 being seated on said axle.

Although in principle, each of the two levers 33 can be mounted separately on a side frame 37; 38 and can be optionally driven by pivot drives which are separate but synchronized in terms of control engineering, the two levers 33 are preferably both non-rotatably arranged on the same one-piece or two-piece shaft 39, e.g. hollow shaft 39, which is driven by a pivot drive. Said hollow shaft is mounted in side frames 37; 38 in radial bearings 35 so as to pivot around pivot axis S. The pivoting of shaft 39 around pivot axis S causes ink vibrator roller 18; 28, supported on levers 33 and having rotational axis R, to pivot on a circumferential line having radius r, which corresponds to an effective lever length. Said pivoting is carried out between a position A, in which the circumferential surface of ink vibrator roller 18; 28 is in contact with ink fountain roller 17; 27 in the end position, and a position B, in which the circumferential surface of ink vibrator roller 18; 28 is in contact with ink distribution roller 19 in the end position. Although a pivot angle σ of lever 33 between the two positions A; B is dependent on the geometry of the rollers and the arrangement thereof, as well as on the lever length, the stated geometry and lever length are preferably such that pivot angle σ is within an angle range of only 3° to 10°, in particular 5° to 8°. This results in an adjustment path in which ink vibrator roller 18; 28 is not subjected to any excess rotational movement as a result of the change in position. A preferred effective lever length between pivot axis and rotational axis R is 60 to 70 mm, for example.

The drive means 32 that pivots the respective lever 33 or the two levers 33 together and engages indirectly or directly on lever 33 or levers 33 is embodied as adjustable in terms of its output side driving force, in particular, it is embodied as restrictable at least in terms of upward force. This enables a force-based adjustment of ink vibrator roller 18; 28. In contrast to purely path-based adjusting movements, which act against a stationary stop regardless of force, here the amount of force acting in the stop is restricted. In the present case, the stop is formed by the circumferential surface of the stationary roller 17; 19 against which ink vibrator roller 18; 28 is placed by means of the pivot drive.

In a represented, particularly advantageous first embodiment, drive means 32 of the pivot drive is embodied as a drive means 32 which is actuated with a compressed medium, in particular compressed fluid, i.e. a fluid under excess pressure, i.e. hydraulically or preferably pneumatically actuated. Said drive means 32 preferably engages indirectly via its driven member 41; 42, which can be moved by the application of compressed medium, and via at least one transmission element, e.g. via at least one lever 33; 43 and/or optionally via a transmission that gears down the movement, or directly via a non-rotatable or at least rotationally stiff connection, e.g. a coupling 44, with shaft 39, for the pivoting thereof. In this case, drive means 32 is preferably embodied as dual-action, i.e. such that the driven member 41; 42 is or can be actively moved in both directions within its range of motion by respectively applying a compressed medium to drive means 32. The principle of drive means 32 is preferably based on the movement of a piston in a piston chamber which is effected by the application of compressed medium, the movement of the piston being transmitted to the driven member 41; 42, which is connected thereto and which can also optionally be embodied as integral with the piston. The side of the piston chamber to which a compressed fluid can be applied for displacing the piston is also referred to here as a compression chamber. A dual-action piston/piston chamber system therefore comprises a compression chamber at each of the two piston ends.

In a first variant of the first embodiment, drive means 32 is embodied as a compressed medium actuated or compressed fluid actuated linear drive 32, e.g. linear motor 32, e.g. as a compressed medium actuable cylinder/piston system 32, more succinctly a compressed medium actuated operating cylinder 32, in particular a pneumatic cylinder 32. Said drive means comprises a housing 46, e.g. cylinder 46, which delimits a piston chamber in which a piston can be moved back and forth axially, with the movement thereof being transmitted to a piston rod connected thereto. Said piston rod, or an extension which is rigidly connected thereto in terms of tension and pressure, forms driven member 41 of drive means 32, which can be moved by applying a compressed medium. In a preferred, dual-action embodiment, the compressed medium can be applied to the piston chamber on both sides of the piston. For this purpose, a port 48; 49, e.g. a compressed medium port 48; 49, is provided in the area of each of the two piston chamber ends and can be connected or is connected to a compressed medium source 47, e.g. a compressed medium reservoir or a compressor, via corresponding lines.

The two compressed medium ports 48; 49 or piston sub-chambers supplied via said ports are each assigned to one of the two above-mentioned positions A; B to be occupied by ink vibrator roller 18; 28 such that when compressed medium is applied to the relevant compressed medium port 48; 49, ink vibrator roller 18; 28 occupies or moves toward a position A; B; of the two above-mentioned positions A; B that corresponds to said port.

Between compressed medium source 47 and compressed medium ports 48; 49, a controllable pressure reducing valve 51, more succinctly pressure regulating valve 51, e.g. proportional pressure regulating valve, is preferably provided, at the output of which a desired pressure level P (P1; P2) can be generated. This pressure regulating valve 51 is preferably embodied as adjustable with respect to the pressure level P (P1; P2) that is provided at its output, and comprises a corresponding adjustment means 52. In principle, the adjustment means 52 can be adjusted manually on site, however it is preferably adjustable remotely as described below by actuating a control means 57, e.g. also via an operator interface 59 for a control means 57.

The force with which ink vibrator roller 18; 28 is engaged against the other inking unit roller 17; 27; 19 or the other rollers 17; 27; 19, and therefore the ink strip width at the nip point, is set by adjusting the pressure regulating valve 51 (manually on site or via an operator interface 59, or automatically via a control means 57). This can be accomplished, e.g. during the initial startup of the machine and/or during maintenance or inspection of the machine and/or when printing conditions change. If the two chambers are supplied via the same pressure regulating valve 51, either the contact force for the two positions against the rollers 17; 27; 19 is equal or pressure regulating valve 51 must alternate between two settings, correlating with the synchronization (see below), for an alternating pressure level P; P1; P2.

In one embodiment, compressed medium source 47, but particularly the output of pressure regulating valve 51 located downstream of said source, can then be connected to the two compressed medium ports 48; 49 via a valve 53 embodied as a switchover valve 53 and having two outlets, for example, advantageously via a multiway valve embodied e.g. as a so-called 5/2-way valve, and corresponding lines. Compressed medium at pressure level P; P1; P2, which is provided by compressed medium source 47 and/or by pressure regulating valve 52, depending on the position of switchover valve 53, can then be alternatingly applied to the two compressed medium ports 48; 49 or to the piston sub-chambers supplied via these. Switchover valve 53 is controlled automatically by means of a control means 56 by actuating an adjustment means 54 assigned to valve 53 using corresponding control signals S. Control means 56, which is used to actuate valve 53, can be embodied as a control circuit 56 or as a program routine 56 and can form a part of a decentralized or centralized control device 58, e.g. a machine controller and/or a control panel controller. Valve 53 is actuated in accordance with the desired vibration cycle T or cycle T (cycle length) and the desired cycle path (path of the various cycle phases), with a full cycle T comprising two switchover processes, for example. Thus a cycle T comprises a phase $\tau_A$ in which ink vibrator roller 18; 28 is in position A, a phase $\tau_{AB}$ during which it is changing position to position B, a phase $\tau_B$ in which ink vibrator roller 18; 28 is in position B, and finally a phase $\tau_{BA}$ during which it is returning to position A. The synchronization to be predefined by control means 53, that is, the periodically recurring pattern and the repetition frequency for the actuation of valve 53, can be predefined and/or modified e.g. via an operator interface 59. For example, the synchronization can correlate to the currently existing machine speed, however a factor that determines the correlation may also be modified at the operator interface 59 or may be automatically selected based on correlations stored in control device 58.

In the case of stored correlations, for production runs involving different production conditions and/or machine settings, correlations and/or factors that differ in terms of vibration cycle and machine speed values can be stored. For example, a correlation of one vibration cycle for every five sheets to be transported through print position 07 may be stored for a certain production run, and a correlation of one vibration cycle for a number of sheets other than five to be transported through print position 07 can be stored for another production run. The factor may vary, for example, from 1 cycle for every 5 sheets up to 1 cycle for every 25 sheets.

In the embodiment in which the correlation can be modified via an operator interface 59, a basic setting of one vibration cycle for every five sheets to be transported through print position 07 can be preset, for example, and can then be modified by operating personnel at operator interface 59.

The mechanically independent pivot drive of ink vibrator roller 18; 28 therefore allows the vibrator synchronization to be adjusted and/or selected independently of the machine speed, or at least without a fixed correlation to machine speed.

As has already been stated, pressure regulating valve 51 can be remotely adjusted with respect to the pressure level P (P1; P) that is provided at its output using a control means 57 (e.g. control circuit 57 or program routine 57), which can make up part of control device 58, which may be decentralized or centralized. For example, for two production situations in which the ink vibrator rollers 18; 28 arranged in inking unit 03; 13 differ in terms of the total fraction or the total length of bearing sections 29, said ink vibrator roller 18; 28 is adjusted to one of the other rollers 17; 27; 19 by applying a compressed medium at different pressure levels P1; P2 to the relevant piston chamber section and/or the relevant pressure port 48; 49. The different pressure level P1; P2 is set by actuating adjustment element 52 via control means 57. A predefined value for the respective pressure level P1; P2 can be predefined and/or modified in this case e.g. via an operator interface or the operator interface 59. For example, a pressure level P1; P2 can be automatically selectable based on correlations stored in control device 58. For this purpose, for production runs having different production conditions, in particular for ink vibrator rollers 18; 28 that differ in terms of the total proportion of bearing sections 29, setting values that differ in terms of pressure level P1; P2 can be stored. In an embodiment in which a setting can be modified via an operator interface 59, for example, a basic setting for pressure level P1 can be predefined, and can then be modified by the operator at operator interface 59.

As an alternative to the described embodiment having an above-described switchover valve 53 which supplies both compressed medium ports 48; 49 and/or piston sub-chambers alternatingly, in a variant not shown here, two individual switchover valves can be provided, synchronized with one another via control means 57, for example, each of said valves being connected on the input side, e.g., to a separate, particularly adjustable pressure regulating valve 51, e.g. a proportional pressure regulating valve. Although this results in higher equipment costs, it enables different contact forces for the two positions A; B by applying different pressure levels P1; P2. The pressure levels P1; P2, which can be different for the two compressed medium ports 48; 49, may also vary in the aforementioned manner based on the total proportion of the bearing sections 29.

To minimize so-called vibrator shock which results when the ink vibrator roller 18; 28 strikes the relevant inking unit roller 17; 27; 19, and ideally to prevent such shock, the length of operating cylinder 32 and/or of the piston chamber can be such that positions A; B of ink vibrator roller 18; 28 are reached when the piston reaches the end position in the cylinder. It can also be particularly advantageous for the operating cylinder to be equipped with end position damping.

Driving means 32, which is embodied as a compressed medium actuated or fluid actuated linear motor 32, as described, engages with a lever 33; 43, e.g. with the lever 33 that supports ink vibrator roller 18; 28 outside of pivot axis S, or with a lever 43 which is non-rotatably connected to shaft 39 and is provided expressly for this purpose. The length of the expressly provided lever 43, which can also optionally be formed by a second arm of the lever 33 that supports ink vibrator roller 18; 28, is preferably greater than that of lever 33 that supports ink vibrator roller 18; 28, e.g. at least twice as long, and measures 140 to 180 mm, for example.

In a second embodiment of the first embodiment example, drive means 32 is embodied as a compressed medium actuated or fluid actuated rotary drive 32, preferably a fluid actuated oscillating piston motor 32, particularly a pneumatically actuated oscillating piston motor 32. Said drive means comprises a piston chamber, e.g. delimited by a housing 61 and extending in the circumferential direction around a rotational axis of a shaft 42, in which chamber a piston connected to the shaft can be moved back and forth on a circular path around the axis of rotation. Shaft 42 or an extension non-rotatably connected thereto forms the driven member 42 of drive means 32, and can be moved by the application of compressed medium. In a preferred, dual-action embodiment, compressed medium can be applied to the piston chamber on both sides of the piston. For this purpose, rotary drive 32 according to the above-mentioned embodiment has two compressed medium ports 48; 49, which, or the piston sub-chambers of which are supplied with compressed medium at one or more pressure levels P; P1; P2 in the manner described above in relation to the first embodiment. For damping vibrator shocks, end position damping means may also be provided here. The above statements relating to the synchronization, actuation, adjustment and operation of the abovementioned variants of the first embodiment can be applied similarly to the second embodiment. Oscillating piston motor 32 or the stator thereof is arranged fixed in relation to the frame, e.g. is at least non-rotatably connected directly or via a retaining device 66, for example via stud bolts 66, to side frame 38.

In an advantageous development of the two embodiments, the pivot drive is prestressed, in particular at a point in the drive train between driven member 42 of drive means 32 and the radial bearings 34 that support the journals 36 of ink vibrator roller 18; 28, in such a way that when drive means 32 and/or driven member 41; 42 has been detached or switched to a resistance-free mode, a force which is exerted counter to the acceleration of the ink vibrator roller 18; 28 that is induced by gravity, preferably a momentum acting opposite the torque induced by gravity, in particular substantially a lifting momentum, is introduced into the drive train. An advantageous prestressing is implemented and set such that, when drive means 32 or driven member 41; 42 is disconnected or switched to a resistance-free mode, the ink vibrator roller 18; 28 does not rest at all, or rests with at most a portion, e.g. at most one half, advantageously at most one quarter, preferably at most one tenth of its weight on the lower of the two inking unit rollers 17; 27; 19 that interact with it. Ideally, the device for prestressing is embodied and set in such a way that, when drive means 32 or driven member 41; 42 has been disconnected or switched to a resistance-free mode—e.g. manually—ink vibrator roller 18; 28 can or could be moved to nearly any position between ductor roller 17; 27 and ink distribution roller 19, and remains or would remain there. In principle, this can be accomplished with, e.g. any type of spring element 62 acting at any suitable point in the drive train. For example, the spring force of a helical tension spring or compression spring could be directed opposite a torque induced by the force of gravity by acting in a suitable manner on the lever 33 that supports ink vibrator roller 18; 28 or on the lever 43 that applies the torque to shaft 39.

In a preferred embodiment, the prestressing device comprises a spring element 62 embodied as a torsion bar spring 62, which on one frame side, preferably on the frame side opposite the input side of shaft 39, is fastened in a torsion-free manner in terms of operation, i.e. during operation of the machine or the printing unit 01, in or on side frame 37; 38, and which in a longitudinal section of shaft 39 which is closer to the opposite side frame 38; 37, e.g. in a region 64 of an end of shaft 33 that is assigned to the input side, is connected to said section in a torsion-free manner. The fastening at the fixed end of the torsion bar spring 62 is preferably embodied such that the torsion-free attachment of the torsion bar spring 62 can be released for adjustment purposes, and the torsion bar spring 62 can be twisted in this end region, and can be refastened after it is twisted. The prestressing applied to shaft 39 can thereby be adjusted and after fastening, can be maintained for continued operation. The torsion bar spring is fixedly mounted by means of a clamp ring 63, by means of which torsion bar spring 62 can be releasably fastened in the frame. Torsion bar spring 62 is preferably mounted such that it extends—particularly coaxially—into the shaft 33 embodied as hollow shaft 39.

Torsion bar spring 62 is embodied, for example, such that it has a spring constant of, e.g. 15 to 30 ncm/degrees, preferably 21 to 26 ncm/degrees in its elastic, e.g. substantially linear adjustment range, but at least in the adjustment range claimed here for the pivoting movement. During pivoting of ink vibrator roller 18; 28, said torsion bar spring has a total stroke over an angle $\epsilon$, e.g. twist or torsion angle $\epsilon$ (e.g. $\epsilon$ being 3° to 10°, especially 5° to 8°), which corresponds to pivot angle $\sigma$ between positions A and B. The prestressing of the torsion bar spring 62 is chosen, e.g. such that torsion bar spring 62 will pivot about a central position of its deflection, e.g. about a mean torsion angle $\delta_0$, which ranges, e.g. from 12° to 18°, in particular from 14° to 16°, and from which it is deflected by one-half the total stroke on both sides, for example, during pivoting of ink vibrator roller 18; 28. Thus as ink vibrator roller 18; 28 is pivoted between position B and position A, torsion bar spring 62 is twisted along its length between the end that is fixed to the frame and the part that is fixed to the shaft by the angle $\epsilon$ between a torsional position b(B) and a torsional position a(A). The torque applied by torsion bar spring 62 for the mean torsion angle $\delta_0$ ranges, e.g. between 3000 and 3800 ncm, preferably between 3200 and 3600 ncm. Because the difference in the deflection angle is small, the torque variation is also small.

In an alternative embodiment to the torsion bar spring 62 for spring element 62, the means for prestressing can also be implemented by means of a connection which is spring elastic in the rotational direction and is established between shaft 42 of rotary drive 32 and shaft 39 that supports lever 33. For this purpose, for example, coupling 44 can be embodied as spring elastic with respect to the transfer of torque between its input side and its output side. The above statements apply similarly to the characterization of the torque that is applied preferably or by way of example for prestressing.

In an alternative embodiment which is advantageous, for example, in terms of an optional interconnected multiple motor drive embodiment and which is not explicitly shown, drive means 67 of the pivot drive is embodied as an electric drive 67 having an electric motor 68, which can be and/or is operated as torque-controlled in at least one operating mode. In this connection it is understood that said motor can be controlled with respect to torque M or with respect to a variable that correlates directly therewith, e.g. an electric power P, or can at least be restricted to a maximum. As the setpoint value, a preset torque value $M_S$ (or a corresponding preset value) can be predefined and/or modified remotely by actuating an adjustment means 69 embodied as a drive controller 69 of electric drive 67. Control signals S that effect the back and forth movement are also supplied by a corresponding control means 56 to drive controller 69 or to a process implemented therein, for example, and in this case effect the synchronized change between clockwise and counterclockwise operation, for example.

Here again, as described above, drive controller 69 can be adjusted in terms of the preset torque value $M_S$ remotely by actuating a control means 57, e.g. also from an operator interface 49 via control means 57. For this purpose, control means 57 is linked via a signals connection to drive controller 69, and control means 57 can be linked to an operator interface 59 via a signals connection.

For the embodiment of drive means 32 which is variable in terms of actuating force or output side driving force and is embodied as mechanically independent of the rotation of printing unit cylinders 02; 04; 12; 14 and inking unit rollers 17; 18; 19; 22; 23; 23; 24; 27; 28 provided in printing unit 01, then regardless of the specific embodiment thereof, the contact force relative to the first and/or second inking unit rollers 17; 19 can be set by remotely predefining and/or modifying a setpoint value for the drive means 32; 67 of the pivot drive by acting on an adjustment means 52; 69. Drive means 32; 67 is embodied as adjustable in terms of its output side driving force by adjusting the setpoint value.

While preferred embodiments of an inking unit of a printing unit, a printing unit and a method for operating a printing unit, all in accordance with the present invention, have been set forth fully and completely hereinabove, it will be apparent to one of skill in the art that various changes could be made to, for example, the printing unit cylinders and their drive assemblies and the like without departing from the true spirit and scope of the present invention which is accordingly to be limited only by the appended claims.

What is claimed is:

1. An inking unit for a printing unit comprising:

at least one first inking unit roller, a second inking unit roller, and a third inking unit roller, which third inking roller is spaced at a distance from the first inking unit roller;

a pivot drive to pivot the second inking unit roller between a first position in contact with the first inking unit roller and a second position in contact with the third inking unit roller, the pivot drive having a drive train including a drive means which is mechanically independent of a rotation of printing unit cylinders and of a rotation of additional inking unit rollers provided in the printing unit;

an adjustment means to remotely set a contact force of the second inking unit roller relative to at least one of the first and the third inking unit rollers by one of predefining and modifying a setpoint value of a driving force of the drive means by the adjustment means;

wherein the drive means is one of a linear drive and a rotary drive which is actuated by applying a compressed fluid to the drive means, to pivot the second inking unit roller between both the first position in contact with the first inking unit roller and the second position in contact with the third inking unit roller by the application of the compressed fluid to the drive means and wherein the contact force of the second inking unit roller relative to the at least one of first and the third inking unit rollers can be set by one of setting and varying a pressure level of the compressed fluid applied to the drive means; and wherein the pivot drive is prestressed by a torsion bar spring element whereby, when the drive means is one of detached and switched to a resistance-free mode, a force which is counter to an acceleration of the second inking unit roller, which force is induced by gravity, is introduced into the drive train of the pivot drive by the torsion bar spring.

2. The inking unit according to claim 1, wherein the drive means is adjustable in terms of an output side driving force by use of the predefined setpoint value.

3. The inking unit according to claim 1, wherein, as the setpoint value, a pressure level of the compressed fluid can be one of predefined and modified remotely by acting on the adjustment means which is embodied as a pressure regulating valve.

4. The inking unit according to claim 1, wherein the one of the compressed fluid actuated linear drive and rotary drive is embodied as a dual-action piston/piston chamber system.

5. The inking unit according to claim 1, wherein a compression chamber of the one of the linear drive and rotary drive is connected by a pressure reducing valve to a compressed medium source for the supply of the compressed fluid and further, wherein the pressure reducing valve is adjustable with respect to a pressure level of the compressed fluid provided at its output by adjustment of the adjustment means.

6. The inking unit according to claim 1, wherein the adjustment means is linked, for its remotely actuated adjustment, to a control means which is embodied as one of a control circuit and a software program, which control means is configured to adjust the adjustment means by one of a command originating from a program routine of the software program and by an input at an operator interface which is connected to the control means.

7. The inking unit according to claim 1, wherein a control means, which is embodied as one of a control circuit and a software program, is provided, by which a valve adjustment means for at least one valve is provided for the synchronized application of compressed medium to at least one compression chamber of the drive means.

8. The inking unit according to claim 7, wherein two compression chambers of the one of the linear drive and rotary drive are connected to the at least one valve, which is embodied as a switchover valve, for the alternating application of compressed medium to said two compression chambers, and the adjustment means is linked to the valve adjustment means for actuating said valve.

9. The inking unit according to claim 1, wherein the drive means is embodied as a pneumatic cylinder having a driven member which is coupled by a lever to a pivotable shaft on which the second inking unit roller is mounted eccentrically to a pivot axis of the pivotable shaft.

10. The inking unit according to claim 1, wherein two first inking unit rollers, each cooperating with an ink source, and two pivotable second inking unit rollers, each cooperating with a respective one of the two first inking unit rollers are provided in a roller train of the inking unit.

11. The inking unit according to claim 10, wherein a separate mechanically independent drive means is provided for pivoting each of the two pivotable second inking unit rollers.

12. The inking unit according to claim 1, wherein the pivotable second inking unit roller is embodied as a sectional roller, and further wherein, viewed in a longitudinal direction of that pivotable second inking unit roller, raised, strip-type, circumferential sections are interrupted by at least one strip-shaped circumferential section that is recessed in relation to a circumferential line of the raised, strip-line, circumferential sections.

13. The inking unit of claim 1, wherein the second inking unit roller can be moved to, and remain in any position between the first position and the second position in response to the pre-stress applied to the pivot drive by the torsion bar spring.

14. A printing unit of a printing machine for simultaneous multicolor printing, comprising:

at least one transfer cylinder, a plurality of forme cylinders that cooperate with the at least one transfer cylinder, and an inking unit for each forme cylinder with which inking unit each said forme cylinder cooperates for its inking, the inking unit having at least one first inking unit roller, a second inking unit roller, and a third inking unit roller, which third inking unit roller is spaced at a distance from the first inking unit roller;

a pivot drive to pivot the second inking unit roller between a first position in contact with the first inking unit roller and a second position in contact with the third inking unit roller, the pivot drive having a drive train including a drive means which is mechanically independent of a rotation of printing unit cylinders and of a rotation of additional inking unit rollers provided in the printing unit;

an adjustment means to remotely set a contact force of the second inking unit roller relative to at least one of the first and the third inking unit rollers by one of predefining and modifying a setpoint value of a driving force of the drive means by operation of the adjustment means;

wherein the drive means is one of a linear drive and a rotary drive which is actuated by applying a compressed fluid to the drive means, to pivot the second inking unit roller between both the first position in contact with the first inking unit roller and the second position in contact with the third inking unit roller by the application of the compressed fluid to the drive means and wherein the contact force of the second inking unit roller relative to the at least one of the first and the third inking unit rollers can be set by one of setting and varying a pressure level of the compressed fluid applied to the drive means; and wherein the pivot drive is prestressed by a torsion bar spring whereby, when the drive means is one of detached and switched to a resistance-free mode, a force which is counter to an acceleration of the second inking unit roller, which is induced by gravity, is introduced into the drive train of the pivot drive by the torsion bar spring.

15. The inking unit of claim 14, wherein the second inking unit roller can be moved to, and remain in any position between the first position and the second position in response to the pre-stress applied to the pivot drive by the torsion bar spring.

16. A method for operating a printing unit having at least one first inking unit roller, and having a second inking unit roller which can pivot between a first position in contact with the first inking unit roller and a second position in contact with a third inking unit roller, which third inking unit roller is spaced at a distance from the first inking unit roller and, wherein the second inking unit roller is pivoted by a drive train including a drive means, including pivoting the second inking unit roller when it is acted upon by the drive means that is embodied as one of a compressed fluid actuated linear drive and a rotary drive, to pivot the second inking unit roller between both the first position in contact with the first inking unit roller and the second position in contact with the third inking unit roller by the application of the compressed fluid to the drive means and which drive means is remotely adjustable with respect to an output side driving force for one of setting and varying a contact force of the second inking roller relative to one of the first and third inking unit rollers by one of predefining and modifying a setpoint valve of the output side driving force of the drive means and prestressing the drive means using a torsion bar spring whereby, when the drive means is one of detached and switched to a resistance-free mode, using the torsion bar spring for introducing a force counter to an acceleration of the second inking unit roller, which is induced by gravity, into the drive train of the drive means.

17. The method according to claim 16, further including applying compressed fluid at different pressure levels to a compression chamber of the one of the compressed fluid actuated linear drive and rotary drive for each of two different production runs.

18. The method according to claim 17, further including adjusting the pressure level of the compressed fluid applied to the one of the linear drive and rotary drive for adjusting a roller nip.

19. The method according to claim 16, further including using the torsion bar spring for pre-stressing the drive means wherein the second inking roller can be moved to, and remain in any position between the first position and the second position.

* * * * *